United States Patent [19]

Bergeron, Jr.

[11] Patent Number: 4,541,479

[45] Date of Patent: Sep. 17, 1985

[54] AIR CIRCULATION SYSTEM FOR GENERALLY ENCLOSED STRUCTURES

[75] Inventor: Hervin J. Bergeron, Jr., Opelousas, La.

[73] Assignees: Stephen J. Ledet, Jr., St. Landry Parish; James D. Elder, Calcasieu Parish, both of La. ; part interest to each

[21] Appl. No.: 639,998

[22] Filed: Aug. 13, 1984

Related U.S. Application Data

[60] Continuation-in-part of Ser. No. 54,659, Jul. 3, 1979, Pat. No. 4,505,325, which is a continuation-in-part of Ser. No. 135,073, Mar. 28, 1980, abandoned, which is a continuation-in-part of Ser. No. 239,982, Mar. 3, 1981, which is a continuation-in-part of Ser. No. 240,152, Mar. 3, 1981, which is a continuation-in-part of Ser. No. 530,211, Sep. 8, 1983, which is a division of Ser. No. 230,375, Feb. 2, 1981, Pat. No. 4,440,343.

[51] Int. Cl.[4] ..... F28D 17/00

[52] U.S. Cl. ..... 165/45; 165/57; 126/400

[58] Field of Search ..... 165/45, 48 R; 237/46, 237/69; 126/400; 165/56, 53, 57

[56] References Cited

U.S. PATENT DOCUMENTS

| | | | |
|---|---|---|---|
| 2,167,878 | 8/1939 | Crawford | 257/3 |
| 2,559,870 | 7/1951 | Gay | 237/1 |
| 2,584,573 | 2/1952 | Gay | 257/9 |
| 2,726,593 | 12/1955 | Lahti | 52/221 X |
| 2,780,415 | 2/1957 | Gay | 237/2 |
| 2,793,509 | 5/1957 | Keen | 62/139 |
| 2,828,681 | 4/1958 | Smith | 62/2 X |
| 2,829,504 | 4/1958 | Schlichtig | 62/3 |
| 3,236,061 | 2/1966 | Wells | 165/48 |
| 3,236,294 | 2/1966 | Thomason | 165/48 |
| 3,354,947 | 11/1967 | McKinnon | 165/50 |
| 3,369,541 | 2/1968 | Thomason | 126/430 X |
| 3,412,728 | 11/1968 | Thomason | 126/431 X |
| 3,415,024 | 12/1968 | Kolartz | 165/53 |
| 3,527,921 | 9/1970 | Voglesonger | 219/213 |
| 3,534,810 | 10/1970 | Limoni | 165/47 |
| 3,758,748 | 9/1973 | Reid | 219/213 |
| 3,874,441 | 4/1975 | Duchene | 165/1 |
| 3,922,832 | 12/1975 | Dicker | 52/742 |
| 3,983,929 | 10/1976 | Thomason et al. | 165/18 |
| 4,010,731 | 3/1977 | Harrison | 126/400 X |
| 4,037,583 | 7/1977 | Bakun et al. | 126/400 X |
| 4,051,891 | 10/1977 | Harrison | 126/400 X |
| 4,051,999 | 10/1977 | Granger et al. | 126/400 X |
| 4,054,246 | 10/1977 | Johnson | 126/400 X |
| 4,089,142 | 5/1978 | Kachadorian | 126/400 X |
| 4,121,563 | 10/1978 | Gold | 126/400 X |
| 4,127,973 | 12/1978 | Kachadorian | 165/45 X |
| 4,139,321 | 2/1979 | Werner | 405/154 |
| 4,173,304 | 11/1979 | Johnson | 126/400 X |

FOREIGN PATENT DOCUMENTS

| | | |
|---|---|---|
| 2521867 | 11/1976 | Fed. Rep. of Germany . |
| 530674 | 12/1940 | United Kingdom . |

*Primary Examiner*—Stephen F. Husar
*Attorney, Agent, or Firm*—John F. Sieberth

[57] ABSTRACT

The system is composed of an aggregate mass through which air can be blown, film sheeting enveloping the mass, and apparatus for directing a flow of air from the interior of a home or other building structure through the aggregate mass and back into the interior. The slab or floor of the home rests on and is supported in part by the enveloped mass. The aggregate mass is a relatively poor conductor of heat and thus heat transfer occurs mainly between the air flowing through the mass and the slab or floor above the mass, and between the air flowing through the mass and the ground below the mass. Preferably, the air from the interior of the building structure is blown into the aggregate mass at an interior location thereof, collected around the perimeter of the enveloped aggregate mass and transferred to the interior of the building structure at peripheral locations in its interior space above but in proximity to the slab or floor. Apparatus for recovering waste heat within the home is also described.

41 Claims, 16 Drawing Figures

AIR CIRCULATION SYSTEM FOR GENERALLY ENCLOSED STRUCTURES

RELATED APPLICATIONS

This application is a continuation-in-part of copending application Ser. No. 54,659, filed July 3, 1979 now U.S. Pat. No. 4,505,325; Ser. No. 135,073, filed Mar. 28, 1980; Ser. No. 239,982, filed Mar. 3, 1981; Ser. No. 240,152, filed Mar. 3, 1981; and Ser. No. 530,211, filed Sept. 8, 1983 which in turn is a division of Ser. No. 230,375, filed Feb. 2, 1981, now U.S. Pat. No. 4,440,343, issued Apr. 3, 1984.

BACKGROUND OF THE INVENTION

1. Field of the Invention

The present invention relates to air circulation systems for generally enclosed structures such as homes having a floor and wall portion.

The present invention more particularly relates to an improved heat transfer and air circulation system for homes and like constructions wherein heat is removed from the home or like construction and stored for later utilization, with a non-conductive aggregate structural circulation medium supporting the home and transmitting circulating air from the home to the area adjacent the underlying soil mass.

2. General Background and Prior Art

In homes and other like constructions, fossil fuels or other energy is spent usually in the form of generated electricity for heating and cooling of the home. Thus, the average home requires energy which is ever shrinking and ever more expensive for its comfortable climate control.

Thus, there is a need for a more efficient system for heating and cooling the home which will allow it to more efficiently and less expensively be temperature controlled without the excessive use of electricity, fossil fuels or other consumed energy.

Most homes are of a slab type construction, meaning that the home sits on a probably four to six inch thick mass of concrete, which is poured on the ground (and some distance below in many cases) and provides a structural support for the home. Other secondary support such as piling can communicate with the slab to provide a structural base which will not sink under the load of the home and the slab itself.

In most climates, in the ground immediately under the slab there is a temperature fluctuation which often times is directly variable with the temperature of the atmosphere around the home yet coincident with the desired temperature in the home. For example, during the heat of the day the soil beneath the home is usually many degrees cooler. Further, in the winter the outside air is usually much cooler than the ground many inches or feet below the ground surface. Indeed, it is recognized that a "frost line" exists below which pipes and other matter will not freeze.

In a like manner, many inches or feet below the slab of the home cooler temperatures exist than in the atmosphere of the home in the mid day heat. Usually, the earth or soil at the frost line is constant temperature year round.

It would thus be desirable to circulate air through a medium provided below the home to the earth and return it to the inside of the home to either supplement the existing cooling system in the home or provide the total cooling system therefor. In winter, heating could be accomplished by circulating air taken from the home to the relatively constant temperature earth, and returning it to the interior of the home.

Many prior art type devices have been patented, which have attempted to solve the problem of air circulation and climate control within homes and similar inhabitable constructions. Many of these devices have provided a medium of some sort beneath the ground through which air can be circulated and heat transfer effected.

In U.S. Pat. No. 2,828,681 issued to Harry F. Smith, there is provided an "Air Conditioning Apparatus". The Smith device depends on an impervious strata and a porous strata. A shaft is provided which is sunk into the strata approximately three feet above the water level, which shaft is combined with an air pump for the purpose of drawing out air from the sub strata. Other shafts are placed about the outlet shaft for the purpose of allowing air to circulate inwardly. The concept of this patent is to draw air for the room or areas to be cooled within a home or similar construction, pump the air down through the strata to outlets where air is passed to the rooms or areas as cool air in the summer. The heat is absorbed by the strata and stored for winter heating.

In U.S. Pat. No. 2,167,878 issued to R. B. Crawford and entitled "Air Conditioning System", there is provided a device directed to the problem of obtaining refrigeration or heating from the earth or ground water. The Crawford device provides a conduit or channel which is lined with precast concrete blocks and has openings 11, which allow water to gravitate into the artificial channel. Flow lines circulate the fluid while a pump pumps the fluid therethrough.

In U.S. Pat. No. 2,559,870 issued to F. W. Gay, there is provided a "House Heating System" which utilizes a fan for circulating air through ducts which collect air beneath the basement of the house structure. Separate compartments are defined by I-beams with the I-beams being inter-connected so as to provide a single air space from side to side underneath the house.

Another patent issued to F. W. Gay is U.S. Pat. No. 2,584,573 entitled "Method and Means For House Heating". This latter Gay patent attempts to supply solar heat to a ground storage chamber thereby increasing the amount of stored heat available for heat pump operation in very cold winter weather.

A further patent issued to F. W. Gay is U.S. Pat. No. 2,780,415 entitled "Heat Pump Operating System For House Heating". A heat stored area is provided beneath the house in this patent which provides a number of trenches traversed by a perforated water pipe embedded in gravel with which each trench is filled.

In U.S. Pat. No. 2,793,509 issued to V. I. Keen and entitled "Method of an Apparatus For Cooling Inhabitable and Other Enclosures", there is provided a plurality of air conveying pipes which communicate with an artificial bed as a heat exchanger. The air is drawn through the conveying pipes to affect a heat exchanging.

A further patent directed to the problem of cooling structures by circulating beneath the building is provided in U.S. Pat. No. 2,829,504 issued to R. C. Schlichtig entitled "Air Conditioning System for Dwellings". An air well is constructed beneath a building unit through which air is flowed for heat exchanging.

In a recent U.S. Pat. No. 4,051,891 issued to Henry Harrison and entitled "Heat Transfer Block Means", a blower is provided which circulates air through a block structure that consists of a plurality of substantially equally sized stones. The stones are grouted or cemented together.

Other prior references dealing with this general subject matter have been cited and discussed in files of the copending applications referred to above.

Some prior art devices require complex structural support for the home or construction. Others do not have adequate detention time provided by their circulation medium for the circulated air to effect proper heat transfer.

In the heat transfer media provided or suggested by some prior art devices/systems, heat conductive material is used, allowing premature heat transfer before air currents reach the underlying earth creating "hot spots" in the circulation medium.

Some systems do not properly insulate the frost line area of the underlying soil to provide a "thermal cap" between the supported structure and the relatively constant temperature frost line area soil mass.

A heating/cooling of the floor area which contacts critical human extremities (as feet) is not achieved by prior art devices without supplemental conventional heating or cooling.

GENERAL DISCUSSION OF THE PRESENT INVENTION

The present invention solves the prior art problem and shortcomings in a very simple and inexpensive manner by providing an effective and workable heat transfer thermal cap system for use under the floor or slab portion of a home to be heated and cooled. The present invention provides an air circulation system for use with generally enclosed structures, such as homes and the like having at least enclosing walls and roof. The apparatus provides a blower for circulating air between the enclosed structure interior and a provided void air space. A preferably aggregate mass of relatively non-conductive, structural air circulation material is provided under the slab portion of the structure continuously communicating with the earth over substantially its entire area. The circulation mass provides structural support to the home or like construction with the uppermost portion of the aggregate mass supporting at least a portion of the slab of the enclosed structure and communicating therewith. A water barrier film sheet envelope surrounds the aggregate mass and prevents water flow into the aggregate mass from the surrounding area. A plurality of air return lines are mounted in the aggregate mass, each providing a fluid conveying conduit having a discharge port at one end portion thereof communicating with the inside portion of the enclosed structure. An intake portion is mounted in the aggregate mass for collecting air within the gravelite mass and transmitting that air through the conduit to the discharge port under the urging of the blower. In the method of the present invention, there is provided an aggregate mass on the underside of an enclosed structure which aggregate mass communicates over substantially its entire area with both the floor/slab portion of the building being supported and cooled as well as with the earth therebelow. Air is collected in the aggregate mass in a plurality of balanced flow independent air return lines. Air is blown from the inside of the generally enclosed structure through an opening in the floor portion thereof to the aggregate mass and circulated through the aggregate mass. Heat is transferred from the circulated air to the frost line portion of the earth and to the slab/floor.

For best results, a small heating unit such as an electrical heating coil is positioned in the blower unit so that a small amount of heat may be added to the intake air as desired during periods of cold weather. Similarly, it is also desirable, especially in humid localities, to include a small cooling coil in the blower unit so that the circulating air may be cooled somewhat during periods when the exterior temperatures are high. For a home having a living area of about 1000 square feet, a 4-kilowatt heating coil and a one-ton (12,000 btu) cooling coil are entirely sufficient for these purposes.

Means is provided for collecting heat from various heat producing elements within the structure, such as fireplaces, dryers, ovens, stoves, and the like. Such collected heat can be connected by means of ducts, conduits, or the like to the blower intake portion for subsequent and immediate circulation into the aggregate mass.

It is an object of the present invention to provide a heat transfer system which evenly distributes collected heated or cooled air through to an aggregate mass for even heat transfer to the earth generally beneath the aggregate mass and frost line.

It is another object of the present invention to provide a heat transfer system in which the aggregate mass also structurally supports the building to be heated or cooled.

It is another object of the present invention to provide a heat transfer system which is simple and easy to construct and easy to maintain.

It is another object of the present invention to provide a heat transfer system which collects wasted heat generated by various heat producing units within the home or like construction such as the fireplace, stove, oven, dryer, and the like, and transfers this heat to the area in the earth generally at or beneath the frost line for later utilization during the winter.

It is another object of the present invention to provide an apparatus for collecting wasted heat within the home and transfer the excess wasted heat to a blower for transfer to the storage area provided beneath the home.

It is another object of the present invention to provide an insulated thermal cap between the home to be heated and cooled and the earth beneath the frost line whereby heat can be added or taken away from the relatively constant temperature earth beneath the frost line for use in the home as needed.

It is another object of the present invention to provide an air circulation medium beneath the home and communicating with the slab/floor portion to maintain a desirable temperature in the slab/floor region.

It is another object of the present invention to provide a heat transfer means which is easy to construct and which evenly transfers and distributes heat without excessive hot spots or localization of heat buildup.

It is another object of the present invention to provide a thermal cap heating and cooling construction for use with homes and like constructions which reduces the cost of heating and cooling of the structure to save energy and money as compared with conventional heating and cooling systems.

It is another object of the present invention to provide a heating and cooling transfer system which eliminates attic duct work as provided in conventional heating and cooling systems.

It is a further object of the present invention to provide a heat exchange system which can incorporate a fire alarm, fire reporting system, and purification and/or deodorizing system for use with an overall air circulation system.

It is still a further object of the present invention to provide an air circulation path which moves through a controlled temperature circulation medium at or near an ideal comfortable temperature level, negating the chance for undesirable heat or cooling loss to the ambient air.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
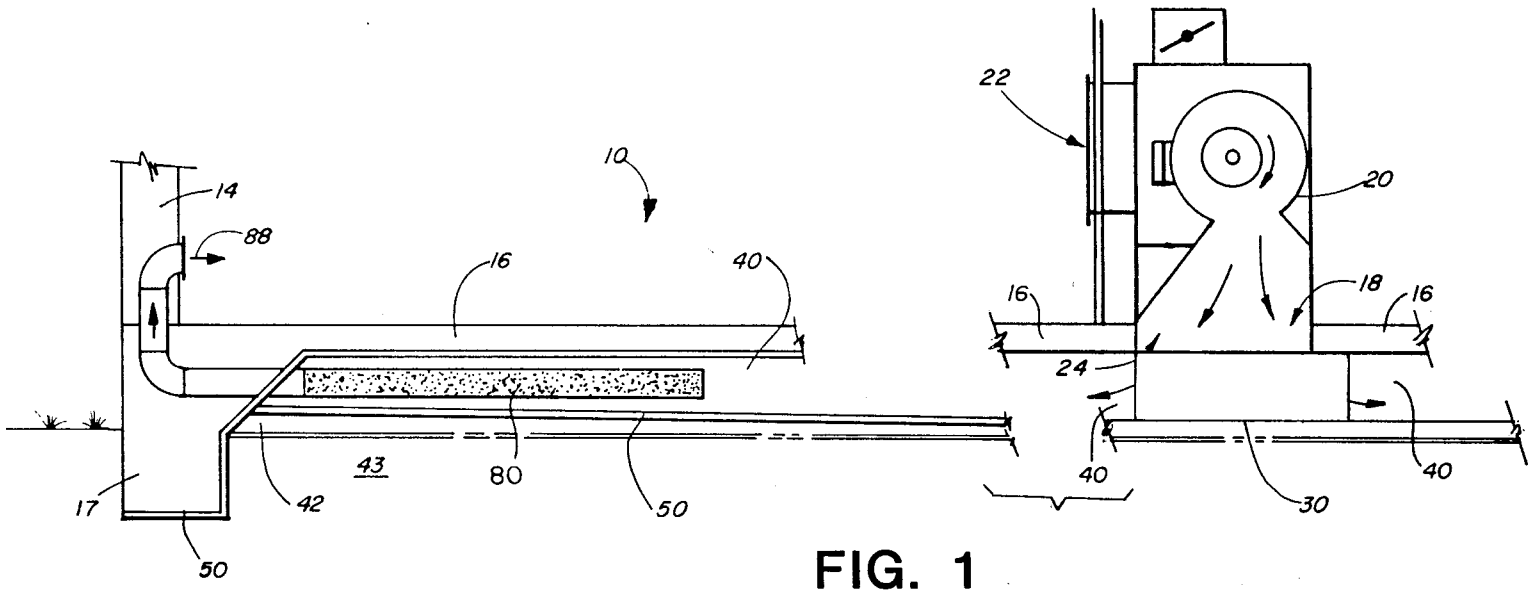
FIG. 1 is a partial sectional view of apparatus of the present invention illustrating the blower, circulation medium, and return air line portions thereof.
Figure 4:
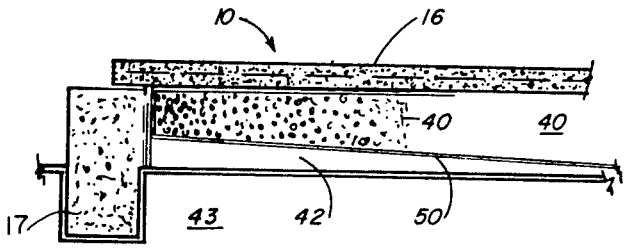
FIG. 4 is a sectional view taken along line 4—4 in FIG. 3.
Figure 5:
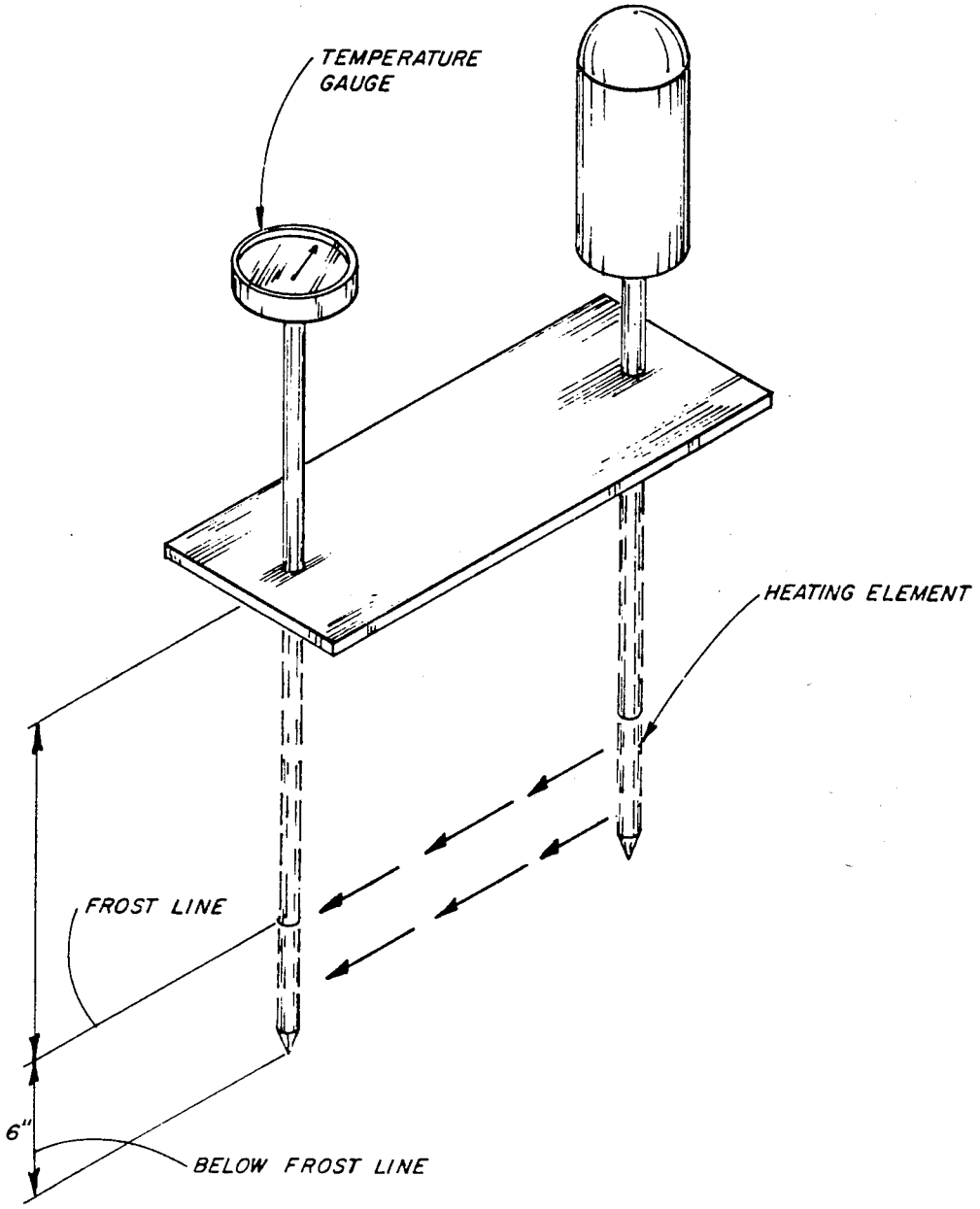
FIG. 5 is a perspective view of a heat storage capacity tester.

FIGS. 1 and 4 provide a partial sectional view of the preferred embodiment of the apparatus of the present invention designated generally by the numeral 10. In FIG. 1 there can be seen a home or other generally enclosed structure having wall 14 portions, a slab 16 portion in the partial view of FIG. 1. It should be understood that walls 14 and slab 16 are only partially shown for illustration and the enclosed structure would likewise have a plurality of outer walls, inner walls, a roof and a continuous slab as is known in the art. An opening 18 is provided in slab 16 at blower 20. Blower 20 provides intake 22 and discharge 24 portions. Discharge 24 is attached to slab 16 at opening 18 and it will be understood that air is circulated generally from intake 22 through blower 20 through discharge 24 and opening 18 to the area beneath slab 16. A screen box 30 is provided at opening 18 to prevent the accumulation of aggregate mass 40 from blocking or otherwise encumbering the flow of air at opening 18. Perimeter wall 17 could support slab 16 and contain aggregate mass 40.

An expanded clay lightweight aggregate mass air circulation medium 40 is provided beneath slab 16. Preferably, a one half to three quarter inch grain size would be provided to each particle or each individual element of material forming expanded clay lightweight aggregate mass 40. Each grain would be preferably highly irregular having an irregular surface with the surface area approximately double that of a symmetrical surface for similar size. An approximate specific gravity of two would be suitable. Expanded clay lightweight aggregate mass 40 would be preferably non-absorbant and non-toxic as well as odorless. A 5 percent activated charcoal content could be added for enhanced filtration. The material would have a high "R" factor and be non-conductive. When air is not in motion, the area below slab 16 becomes an insulated area with little heat transfer between slab 16 and soil mass 43 or sand layer 42. Such a grain size in a mass would be a structural material in which the expanded clay lightweight aggregate mass would be used in an air circulation and heat transfer system. Preferably a one third solids to two thirds air space would be provided for as a volume specification.

A suitable lightweight aggregate for structural concrete or lightweight aggregate for concrete masonry units would be suitable as a material for expanded clay lightweight aggregate mass 40. Such a material is seen in the American Society for Testing and Materials, ASTM standards, especially ASTM designation C331-64T and ASTM designation C330-68T. ASTM designation C331-64T and ASTM designation C330-68T are specifications incorporated herein by reference.

An expanded clay lightweight aggregate mass 40 as above described and specified is a material which is extremely suitable for structural support of a home or other structure including the slab 16 portion thereof. At the same time, it has been found that such aggregate mass 40 is a suitable filter material while having characteristics which provide excellent air purification and a grain size of three-quarter inch to one inch allows easy flow of air through mass 40 which is deposited beneath slab 16. In FIG. 1, a mass 40 of expanded clay lightweight aggregate is provided above sand layer 42. Sand layer 42 could be, for example, a few inches in thickness and provides a further firm base upon which slab 16 and mass 40 can be rested. Sand layer 42 is not essential, but can be used as a grading material to set the desirable slope for film layer 50 which produces proper water flow (once collected by mass 40 and drained by gravity to film layer 50).

Figure 2:
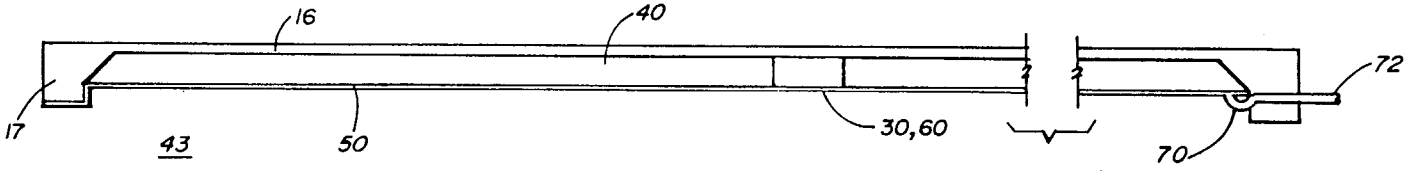
FIG. 2 is a sectional view of the slab portion of a conventional home with the circulation medium and apparatus of the present invention associated therewith.

A film layer 50 of preferably black VISQUUEEN® film or other suitable water impervious plastic material envelops mass 40 and separates it from slab 16 and from soil mass 43 or sand layer 42. Plastic film sheet envelope 50 would for example be of double thickness six mil VISQUUEEN® film and would act as a barrier for preventing encroachment of water into medium 40. In the preferred embodiment, circulation mass 40 could be approximately eight inches thick at the edge 42 portions of medium 40 and preferably 12 inches at the center thereof providing a slope to the center. Film sheet layer 50 would also be a ground water barrier. In FIG. 2 there can be seen slab 16, medium 40, VISQUUEEN® or other plastic film layer 50 below which would be soil mass 43 or sand mass 42. Note that medium 40 supports slab 16 and communicates therewith. Since air flowing in medium 40 will be at or near an ideal temperature, slab 16 will be heated or cooled accordingly by heat transfer with the air flowing in medium 40 giving a pleasing temperature to floor/slab 16 for walking on, even with bare feet in extreme outside temperature months.

At the central portion of medium 40 is provided a water drain lintel box 60. In the preferred embodiment, lintel box 60 would be of a screen mesh material which would allow water to drain freely through medium 40 on top of plastic layer 50 to lintel box 60. The lower portion of lintel box 60 would provide a drain pipe 70 (see FIG. 7) which would discharge water collected therein to the outside portion of slab 16 at effluent 72. Lintel box 60 and screen box 30 could be one and the same.

Figure 3:
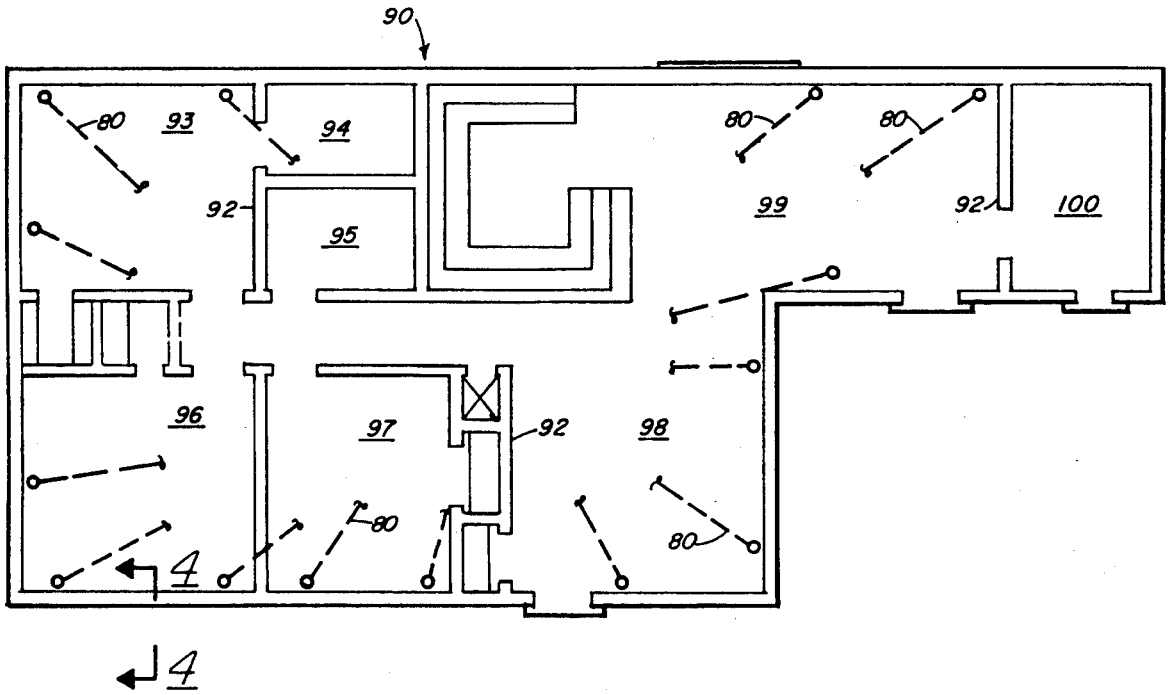
FIG. 3 is a plan view of a typical generally enclosed structure such as a home showing the air return line portions and their placement.

In FIG. 3 there can be seen a plan view of a typical home or other generally enclosed structure designated by the numeral 90. In FIG. 3 a plurality of inner walls 92 divides structure 90 into separate rooms 93–100. In FIG. 3, schematically illustrated are a plurality of return lines 80. Each return line 80 is shown as it is placed under slab 16 through circulation medium 40. Lines 80 so placed will allow air to be discharged into structure 90 at desired points and in desired volumes for a balanced air flow system. In FIG. 3 there can be further seen schematically illustrated the placement of blower 20 at the central portion of structure 90 with the intake 22 portion thereof also schematically illustrated. It will be appreciated from the above description that air flow will be generally from blower 20 downwardly through slab 16 and discharge opening 18 through screen 30 to continuous circulation aggregate mass 40. Thereafter, air will intermix with aggregate mass 40 and heat transfer with slab 16 and soil mass 43 as well as air filtration will take place. Since air flow generated by blower 20 will be furnished at for example 1200 to 2000 cubic feet per minute, the openings provided through each air return line 80 will allow for the return of air therethrough as shown by arrow 88 in FIG. 1.

Figure 7:
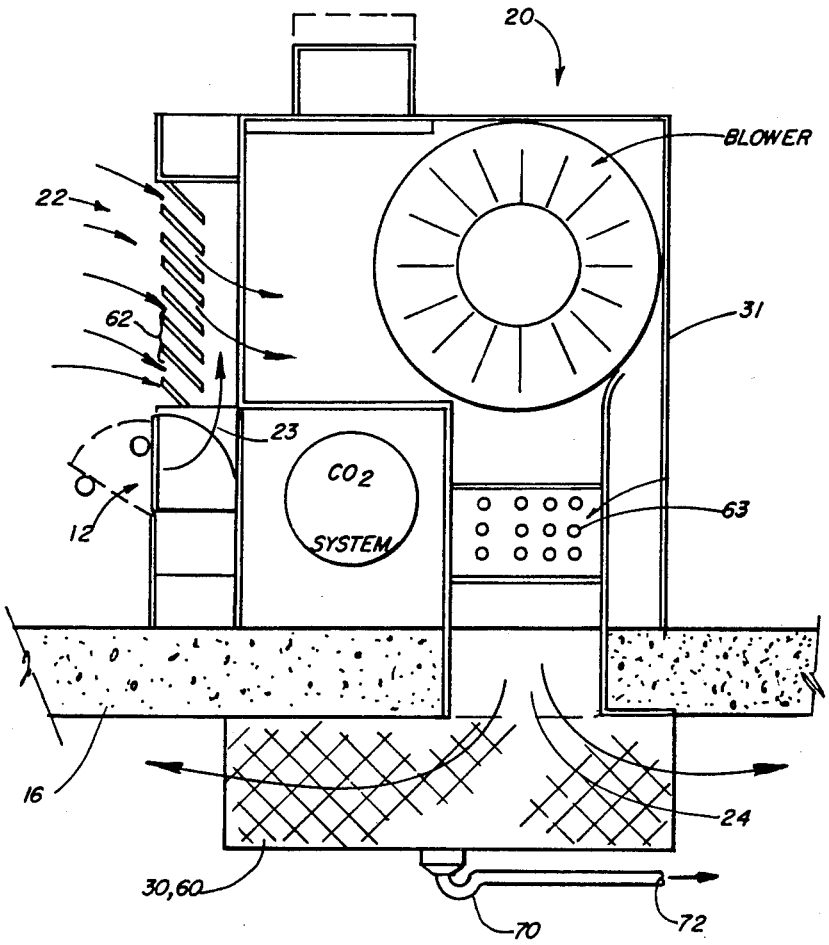
FIG. 7 is a detail of the blower and intake chamber portion of a preferred embodiment of the apparatus of the present invention.

FIG. 7 more particularly shows the construction of blower 20. Blower 20 is housed in a blower chamber 31, which provides intake 22 and discharge 24 portions. Louvers 62 can be provided to control the volume of air intake as desired. A draft box indicated generally by the numeral 12 can be provided into which could be placed any desirable aromatic, medicinal, or like chemical substance which would intermix with air traveling through intake 22 as indicated by arrow 23 in FIG. 7.

As aforementioned, supplementary heating in the form of coils 63 could be provided at discharge 24. A carbon dioxide or like extinguisher or smoke alarm system could be provided to blower 20 which could be injected at discharge 18 for subsequent entry into the home in the event of fire.

Figure 8:
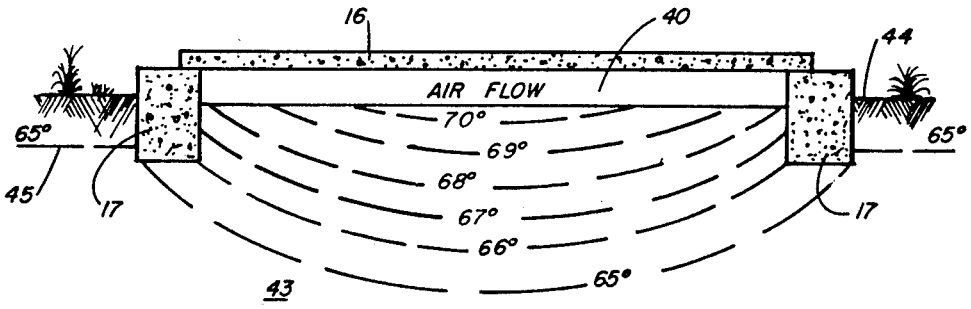
FIG. 8 is a sectional schematic illustration of the thermal cap-frost line as relates to a preferred embodiment of the apparatus of the present invention.

In FIG. 8, there is seen schematically the thermal cap portion of the preferred embodiment which is provided under slab 16 and above soil mass 43 at ground surface 44. Frost line 45 is also schematically illustrated to indicate that a relatively constant temperature is provided at soil mass 43 of for example, between 65 and 70 degrees.

It should be understood that soil mass 43 beneath mass 40 will be of relatively constant temperature year round. An excavation may be made depending on the depth of the frost line in a particular area to provide a space within which circulation mass 40 will be placed. Slab 16 will be placed on top of circulation mass 40 and be structurally supported thereby. Peripheral walls 17 as above discussed would provide peripheral support to slab 16 and containment of mass 40 at the side portions. Thus, an overall thermal cap is provided between slab 16 and soil medium 43 which controls and keeps constant the temperature as desirable of the soil mass 43. Since mass 40 is structural, it supports slab 16. Since mass 40 is relatively non-conductive, air circulated into mass 40 will heat transfer at soil mass 43 and at slab 16. During periods of high humidity, as in summer months, water will accumulate on individual particles of medium 40 which will be a spot for heat transfer and some heat transfer will be affected at particles in that instance. Since the air circulation medium 40 is contained under slab 16 and within peripheral wall 17 and above soil mass 43 and communicates therewith, a relatively constant temperature, thermal cap is provided through which air will flow on a year round basis. Thus, the intake air during extreme months will not be ambient air as is the case with conventional systems. For example, if outside temperature is zero degrees Fahrenheit, a heating unit must take zero degree air and transform it into sixty-eight degree Fahrenheit air or seventy degree Fahrenheit air, etc. With the present invention, ambient air is not needed, but rather the blower circulates air into the relatively constant temperature thermal cap provided through circulation medium 40 and as above described, thus air entering medium 40 will be at or near an ideal temperature with very little transfer needed, since the air is not ambient, but only needs to be heated or cooled on the order of five to twenty degrees Fahrenheit as exemplary.

Figure 6:
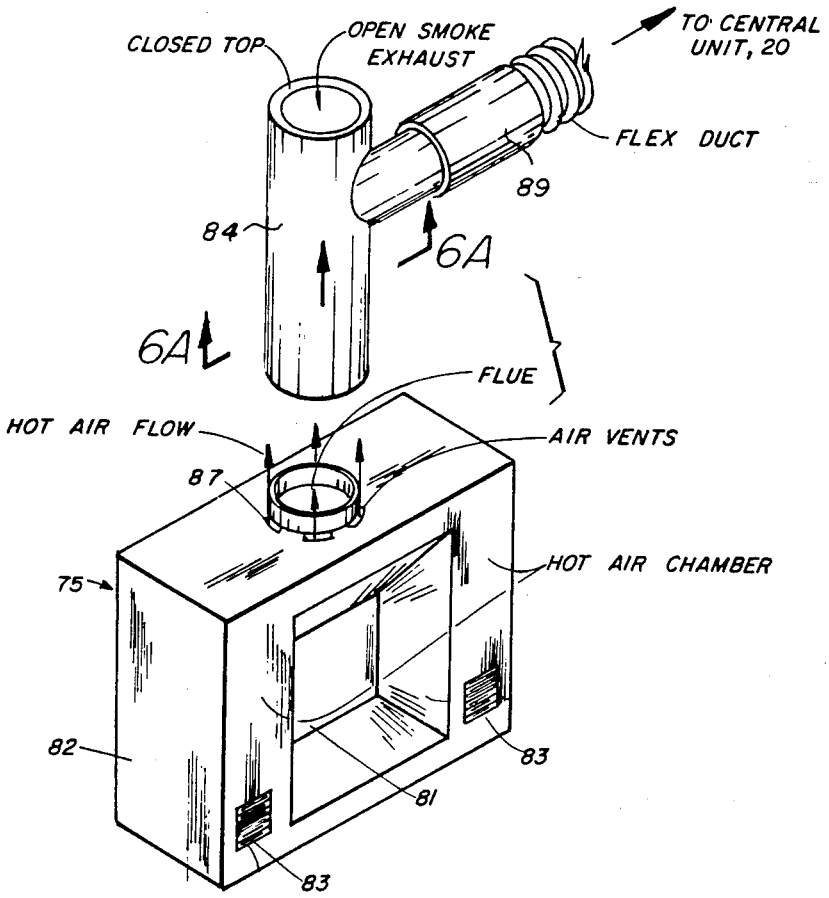
FIG. 6 is a partial perspective view of a fireplace excess heat collection unit.
Figure 6A:
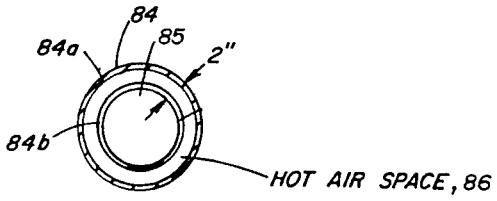
FIG. 6A is a sectional view taken along lines 6A—6A of FIG. 6.
Figure 9:
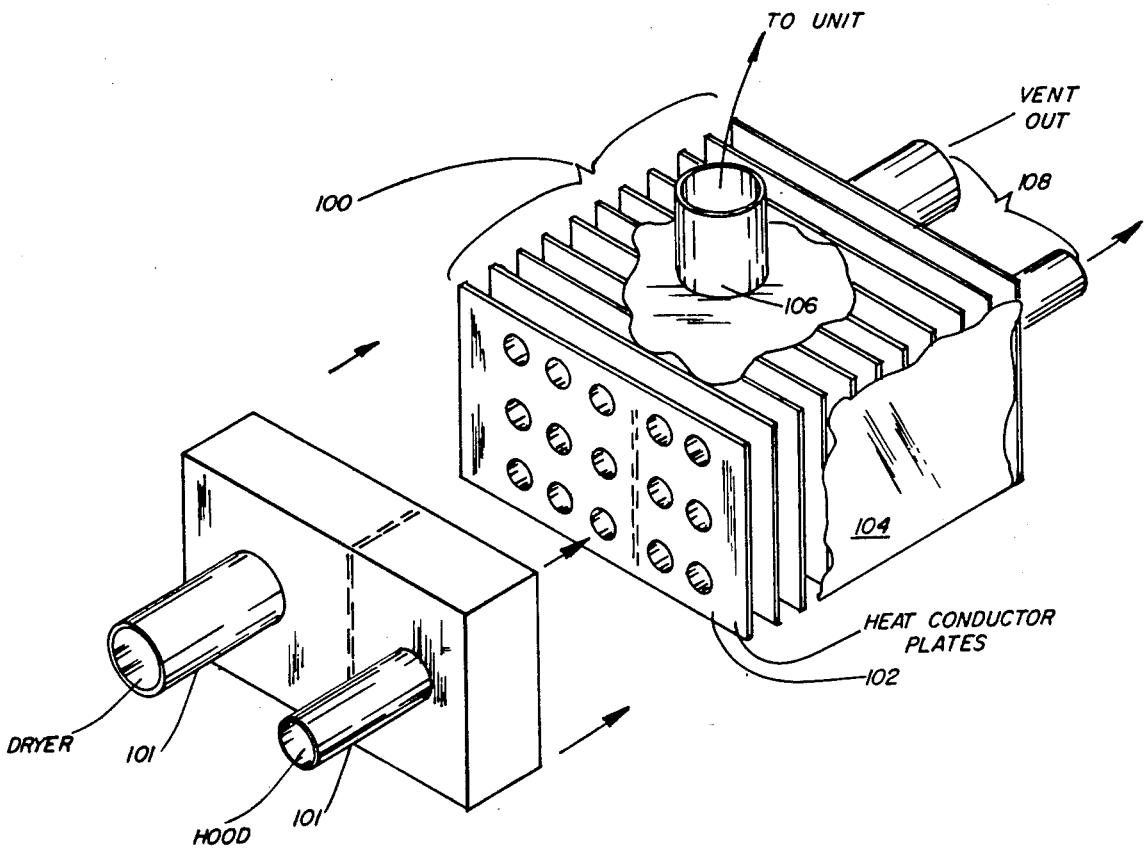
FIG. 9 is a partial sectional view of an excess heat collection assembly.

FIGS. 6 and 9 provide devices which could be used with the preferred embodiment of the apparatus of the present invention to further enhance collection of heat which normally would be wasted and route this collected excess of waste heat to blower 20. In FIG. 6 there is provided an excess heat collection unit 75 for use with a conventional fireplace.

Collection unit 75 provides a double wall casing 82 surrounding a conventional fireplace. Air intakes 83 are provided through which air would be pulled by the force of blower 20 into casing 82 and thereafter drawn through openings 87 into double flue 84. Flue 84 provides an inner **84*b* and outer 84*a* wall construction having an inner space 85 through which smoke would be exhausted and a hot air space 86 through which clean air from opening 83 is passed through openings 87, space 86 and duct 80 to blower 20. Thus, heat transfer from the fireplace 81** would be achieved.

FIG. 9 provides a suitable excess heat collection apparatus 100 for use with for example any number of hot air producing appliances such as dryers, range, hoods, and the like. A pair of intake lines 101 are shown in FIG. 9 which would communicate with the discharge portions of a dryer, hood, or like heat producing unit. A plurality of heat conductive plates 102 are provided to collection unit 100, with a plurality of openings provided in each plate 102. An outer casing 104 encapsulates on three sides for example plates 102 with the last side remaining opened to allow the intake of air. A discharge tube 106 is provided which would communicate with blower 20 and discharge heated air thereto. Vent tubes 108 are provided as needed corresponding to each intake tube 101 for each appliance or like device which would produce heat.

Figure 10:
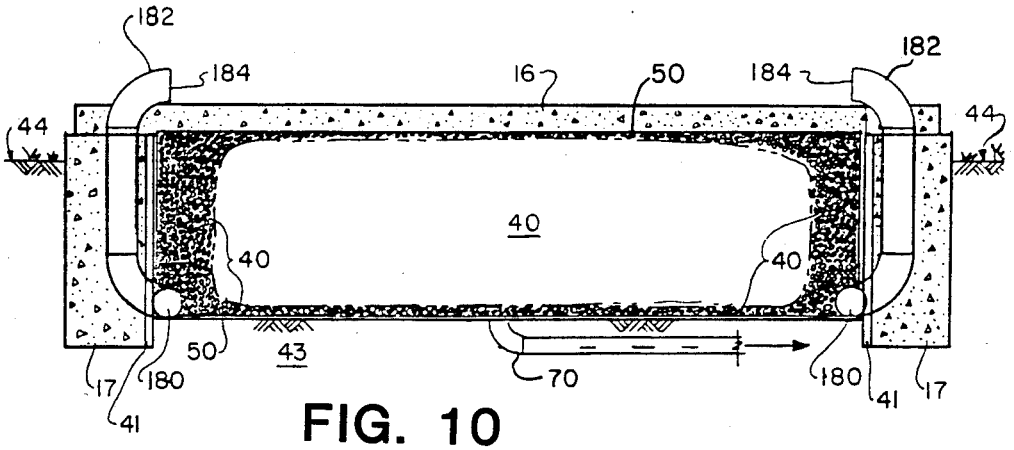
FIG. 10 is a sectional view of another form of apparatus of this invention illustrating the circulation medium, return air line portions, and perimeter insulation.

FIG. 10 shows an insulation barrier 41 positioned around the inner surface of footings 17. Insulation barrier 41 should extend around the entire periphery of the footings 17 and although shown positioned on the interior side of the footings, barrier 41 may be positioned on the exterior side or on both the interior and exterior sides of the footings. Preferably the insulation barrier(s) 41 will extend down to the frost line, if any.

Also depicted in FIG. 10 and in FIGS. 11–15 as well is the positioning of a continuous peripheral perforated header 180 for collecting the air being blown through aggregate mass 40. From header 180 air is conveyed by branch lines 182 to the interior portion of structure 90.

Figure 11:
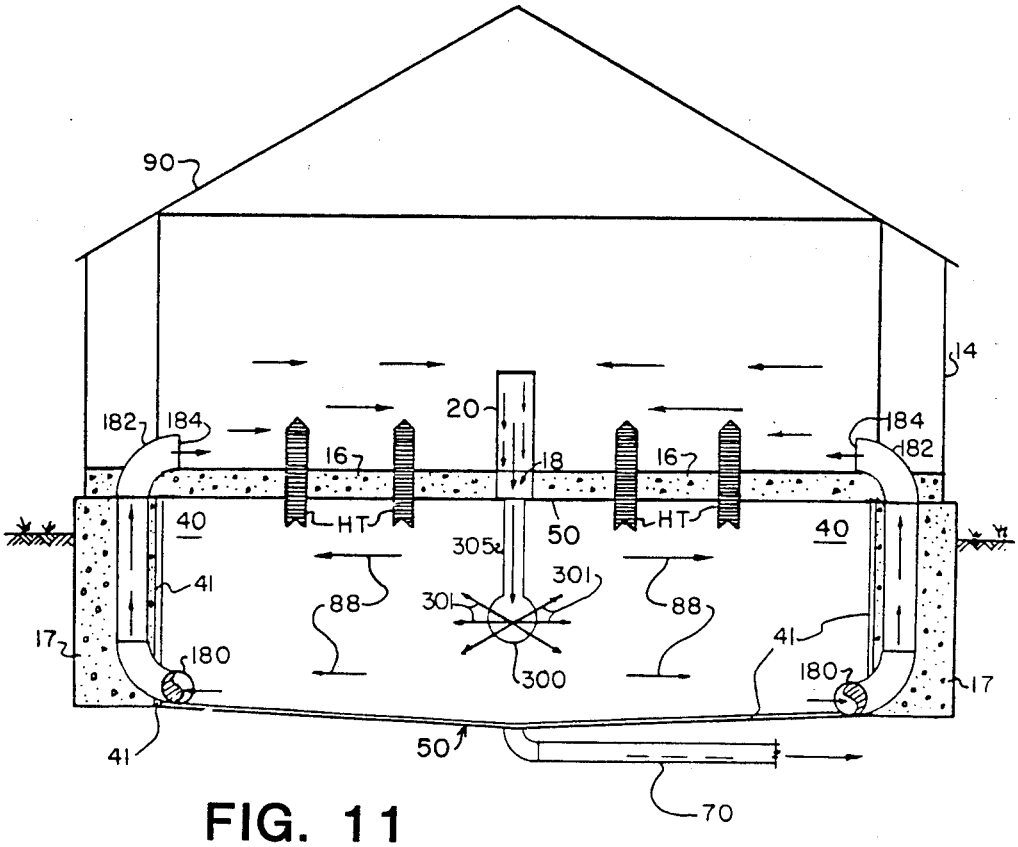
FIG. 11 is an elevational sectional view of preferred apparatus of the present invention schematically illustrating the general air circulation path therewithin.
Figure 12:
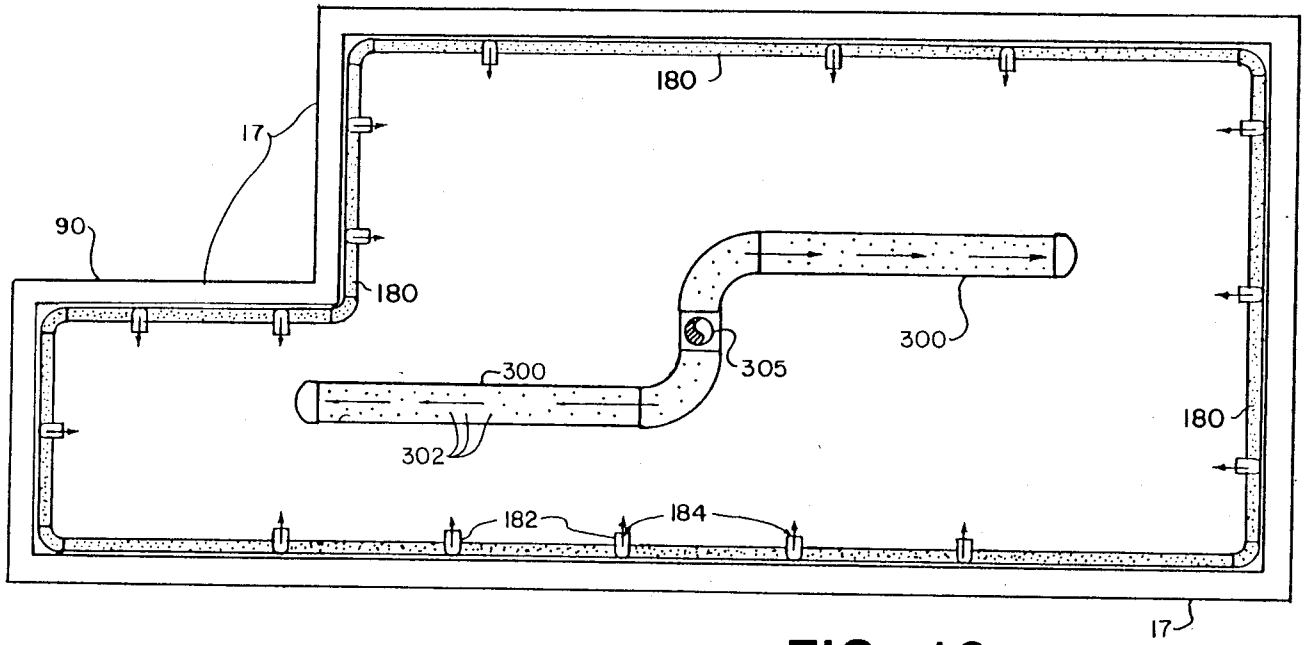
FIG. 12 is a top view of preferred apparatus of the present invention with slab/floor and aggregate removed to expose the air circulation plenum and return air flow portions of the system.

FIG. 11 depicts air flow of the preferred embodiments of the invention. Note that air flows generally downward from blower 20 through opening 18 into either lintel box 30, 60 (note FIGS. 1 and 7), or a provided perforated plenum 300 (note FIGS. 11 and 12). As shown in FIG. 12, plenum 300 for example could be a relatively large pipe having perforations 302 and being distributed as required through the centeral portion of medium 40 to assure a balanced air flow through medium 40 outwardly to perforated peripheral header 180 or to return lines 80. Plenum 300 receives air flow downwardly through vertical shaft 305, and the air passes from the bore of plenum 300 outwardly through perforations 302 as indicated by arrows 301 of FIG. 11 and toward continuous footing 17 as indicated by arrows 88 in FIG. 11 for return air flow through return lines 182. In FIG. 12, slab 16 and medium 40 have been removed to show more clearly the placement of continuous perforated header 180, plenum 300 and return lines 182. In FIG. 11, arrows show the general flow of air from blower 20 downwardly through slab 16 at opening 18 into plenum 300 and outward toward headers 180 and return lines 182. Air is discharged into the interior of structure 90 at discharge openings 184 which can be provided with conventional grill covers equipped with deflectors, or other air flow controllers as is the case with conventional duct air control systems. The fanciful arrows HT indicate the direction of heat transfer across slab 16 when the temperature of the air flowing in aggregate mass 40 is higher than the temperature of the slab itself.

Figure 13:
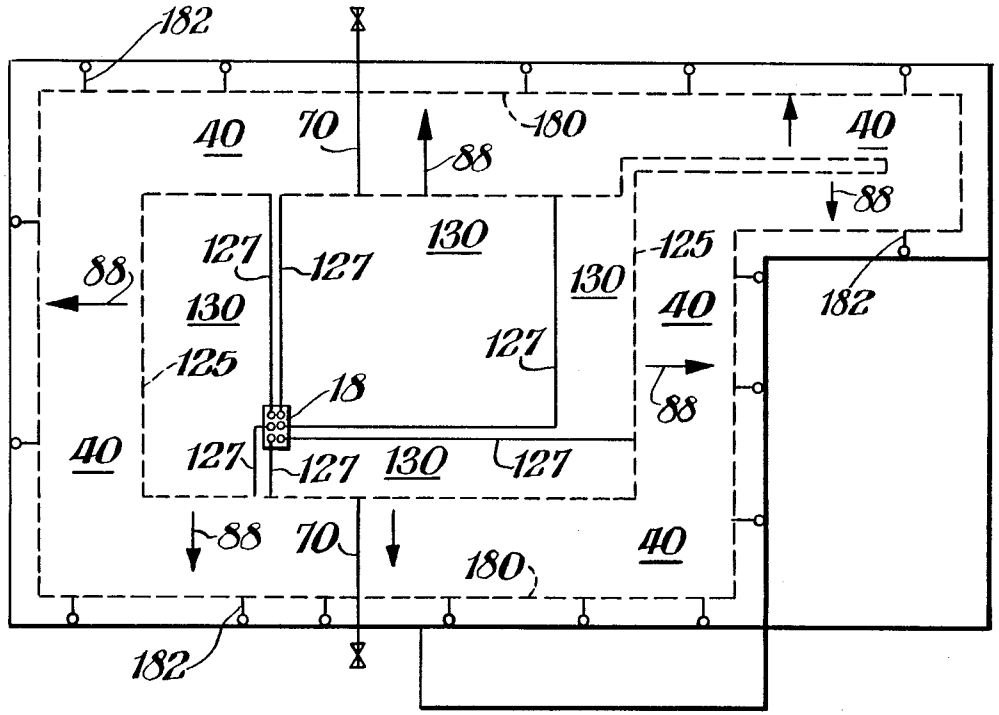
FIG. 13 is a plan view schematically depicting use of a perforated plenum in the form of a closed loop fed by a plurality of conduits.

FIG. 13 schematically illustrates a preferred embodiment in which a lesser amount of aggregate mass 40 can be successfully employed in the practice of this invention. This embodiment, as in the case of the embodiment depicted in FIG. 12, involves use of a continuous perforated header 180 positioned around the perimeter of aggregate mass 40. Return lines 182 branch from header 180 at appropriate locations around the perimeter of the system and enable discharge of return air to the structure interior at a plurality of locations around its perimeter. However in the case of the embodiment of FIG. 13 perforated plenum 125 in the form of a continuous closed loop serves as the means for distributing the air into aggregate mass 40. Plenum 125 in turn is fed by a plurality of tie lines 127 which receive air from blower 20 (not shown) in the vicinity of opening 18. Tie lines 127 intercept plenum 125 at suitably spaced locations so that the air emanates outwardly from plenum 125 in a substantially uniform flow at all locations around its loop. The flow of air from plenum 125 to header 180 is depicted by arrows 88 and of course aggregate mass 40 is positioned under slab or floor 16 (not shown) in the space between plenum 125 and header 180. With structures having a living area of about 1000 to 1600 square feet, a distance between plenum 125 and header 180 of from about 4 to about 8 feet will usually suffice when the aggregate mass has a depth in the range of about 4 inches to about 1 foot. Within the rectangular area to the interior of plenum 125, a mass of sand, earth or gravel 130 is employed in lieu of the aggregate mass. Consequently, the amount of aggregate used in the system is minimized. Tie lines 127 are embedded in mass 130, and aggregate mass 40 together with plenum 125 and header 180 are encased in film sheet 50 (not shown). Preferably this film sheet envelope is penetrated only by tie lines 127, return lines 182, and drain lines 70. Drain lines 70 extend from the lowermost portions of the encased aggregate mass to an exterior valve or faucet. On opening the valve, water that may have collected with the encased aggregate mass is blown out of the system via lines 70 by virtue of the pressure from blower 20. It will be noted that slab or floor 16 (not shown) is supported in its innermost region by mass 130, at its outermost region or perimeter by footings 17 (not shown) and in the intermediate region therebetween by aggregate mass 40.

Figure 14:
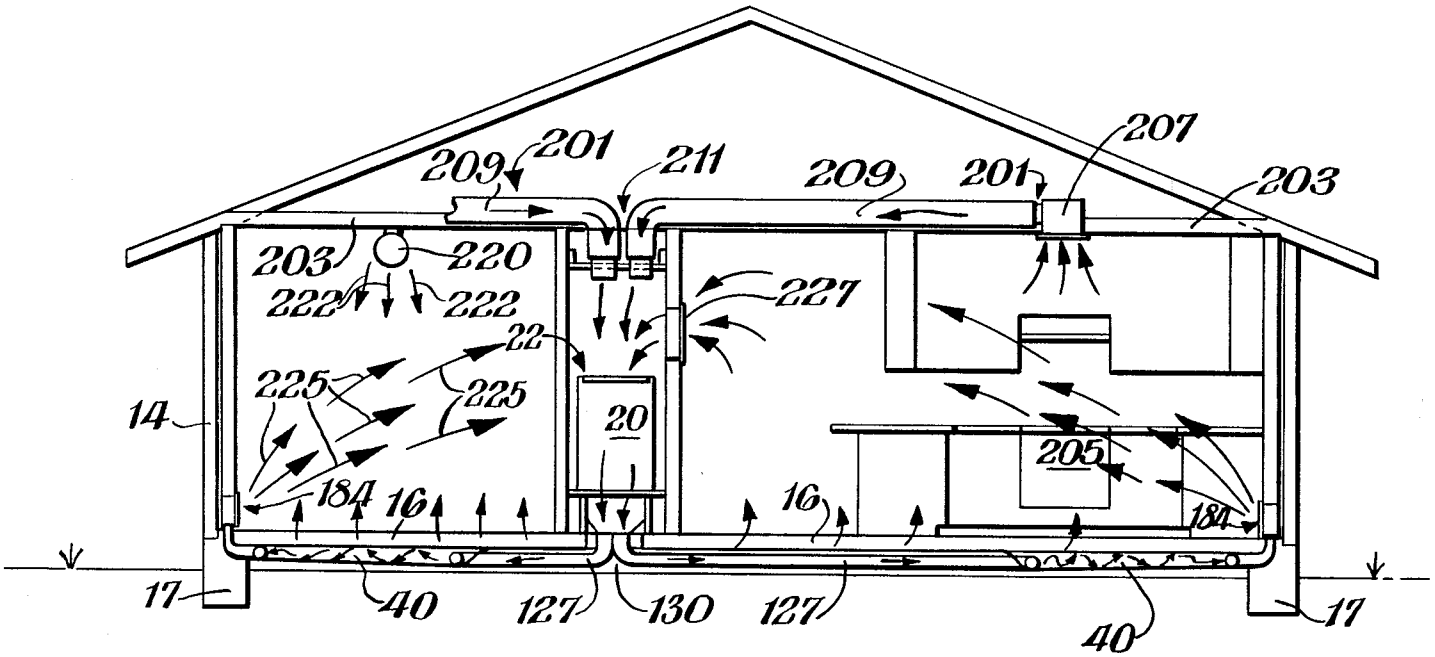
FIG. 14 is a sectional elevation illustrating air flow patterns in an enclosed structure equipped with preferred apparatus of this invention.

FIG. 14 depicts a generally enclosed structure equipped with a slab support and sub-slab air distribution and air return combination of the type schematically illustrated in FIG. 13 in which a preferred type of system for recovering waste heat is employed. This heat emanates from such sources as kitchen ranges, stoves and ovens, fireplaces, clothes dryers, electric light bulbs, hot water heaters and the like. By virtue of the air circulation patterns utilized in this embodiment heated air from all such sources is captured to a large extent and introduced into the aggregate mass 40 so that heat transfer with slab 16 above mass 40 and with soil mass 43 below mass 40 is able to occur. The arrows emanating from slab 16 in FIG. 14 depict the situation as it exists when the waste heat is being used in warming the interior of the structure, i.e., heat transfers across slab 16 into the interior so that heating of the interior occurs from the floor area by conduction. Still referring to FIG. 14, in a suitable position in ceiling 203 above electric range or gas stove 205 is mounted air intake unit 207. Flexible duct 209 is connected to a side opening in unit 207 and extends across the structure above the ceiling to well 211 located at an interior position above blower unit 20. Duct 209 is elbowed downwardly into well 211 and terminates at an appropriate distance above unit 20. The discharge end of duct 209 is preferably equipped with a damper, louvers or other similar mechanism for regulating the amount of air flow. A portion of another similar heat recovery assembly is shown in FIG. 14 which may be used to collect heated air from a fireplace, clothes dryer, hot water heater or other similar heat source. Preferably flexible ducts 209 are thermally insulated and well 211 is filled with suitable insulation material.

Figure 15:
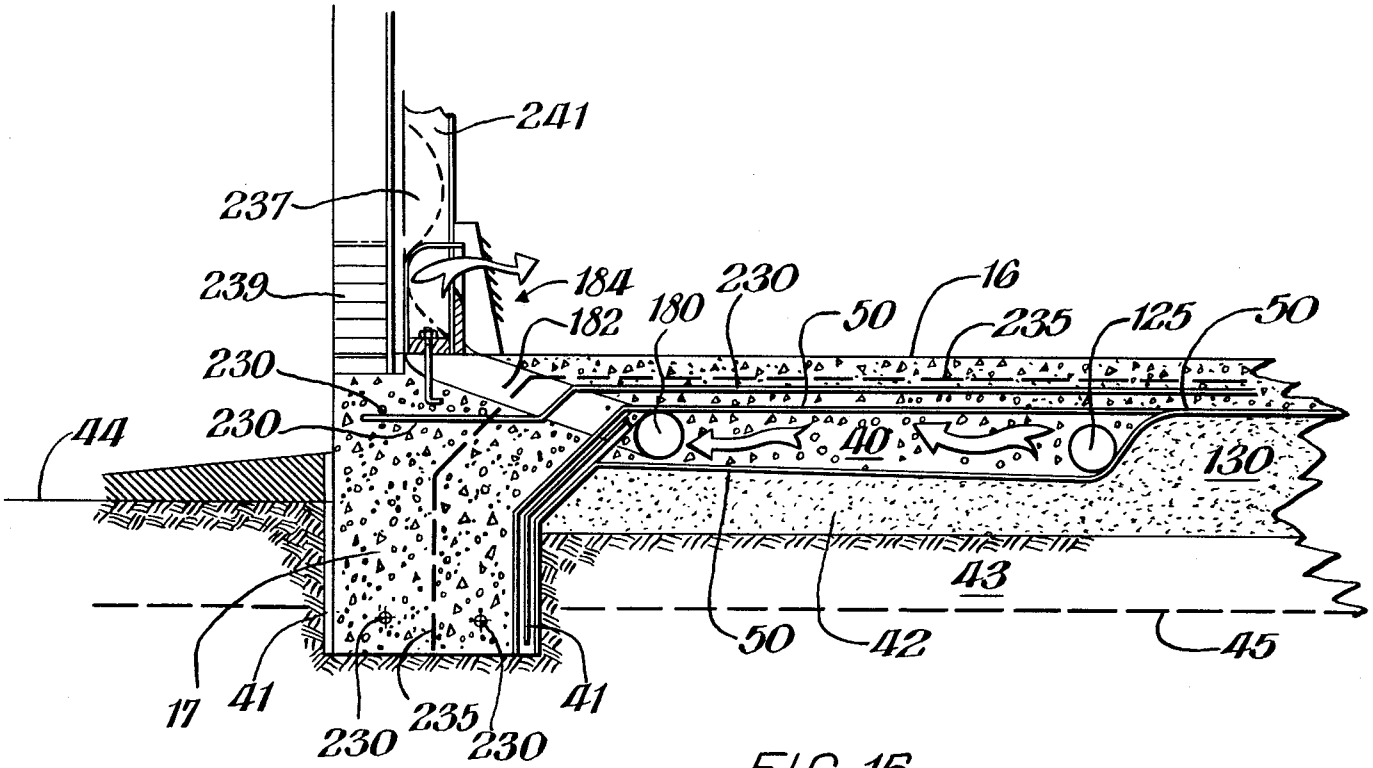
FIG. 15 is an enlarged fragmentary sectional elevation of a preferred construction arrangement for the sub-slab and peripheral wall areas of a structure equipped pursuant to this invention.

FIG. 15 is an enlarged view illustrating in greater detail desirable construction features of the preferred system depicted in FIG. 13. Of particular interest in FIG. 15 is the desirable manner by which aggregate mass 40, perforated plenum 125 and perforated header 180 are encased in the plastic film envelope 50. It will be seen that at least two sheets of film 50 overlie mass 130 preferably composed of sand. The sand is graded as shown to furnish sand layer 42 below aggregate mass 40. At least one such film sheet 50 extends over the top of sand layer 42 and beneath perforated plenum 125, aggregate mass 40 and perforated header 180 to the inner side of interior insulation barrier 41, and then under interior barrier 41 and footing 17. At least one other such film sheet 50 extends from the top of mass 130 and above perforated plenum 125, aggregate mass 40 and perforated header 180 to the outer side of interior insulation barrier 41 against the inner side of footing 17, and then under footing 17. Thus, in this arrangement the sheets are in effect sealed together under footing 17 and above mass 130 (i.e., between mass 130 and slab 16) and encase interior insulation barrier 41 and well as header 180, mass 40 and plenum 125 within the envelope so formed. It will also be noted that in pursuance of preferred practice, insulation barriers 41 are positioned on both the interior and exterior sides of footing 17 and both extend down to below frost line 45. The positioning of aggregate mass 40 above ground level 44 with little or no excavation except for the footings 17 is also illustrated in FIG. 15. Still further, the use of reinforcing rods 230 and wire reinforcement 235 in slab 16 and footings 17, and the use between brick veneer 239 and studs 241 of foamed insulation 237 preferably having a foil backing are shown in FIG. 15.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An air circulation system for generally enclosed structures, as a home, having an interior space defined in part by a slab/floor, said system comprising:

a. a structurally supportive lightweight aggregate mass subsurface to the slab/floor and a structurally communicating with ground support thereunder, said mass forming a structural support for at least a portion of the slab/floor and defining an enlarged void air space between said slab/floor and the underlying ground support;

b. blower means for circulating air between said interior space and said void air space;

c. film sheet enveloping said mass for preventing water flow into said mass from the surrounding area;

d. return air flow conduit means for carrying air from said void air space to said interior space; and e. insulation means for thermally insulating said void air space and said mass around the perimeter thereof and adapted to allow heat transfer between said void air space and the slab/floor and between said void air space and the underlying ground support.

2. The apparatus of claim 1 further comprising independent flow control means associated with said return air flow conduit means for balancing air flow between said void air space and said interior space.

3. The apparatus of claim 1 further comprising drain means under said mass and penetrating said film sheet envelope for collecting and draining water which drains by gravity from said mass to said drain means.

4. The apparatus of claim 3 further comprising conduit means associated with said drain means for transmitting water collected by said drain means to a desired point of discharge.

5. The apparatus of claim 1 further comprising heat transfer means associated with said blower means for effecting heat exchange with air discharged by said blower means to said mass.

6. The apparatus of claim 5 wherein said heat transfer means comprises a plurality of heating coils.

7. The apparatus of claim 1 wherein the return air flow conduit means include a continuous perforated header positioned around or in the perimeter portion of said mass for collecting air from the enveloped aggregate mass and transferring the collected air to the interior of the generally enclosed structure at peripheral locations in its interior space above but in proximity to the slab/floor thereof.

8. The apparatus of claim 7 further characterized in that it includes thermal insulation material extending downwardly into the ground at the site of said structure, said material being positioned around the perimeter of the site of said structure and adapted to thermally insulate said mass around the perimeter thereof.

9. The apparatus of claim 8 wherein said insulation material extends downwardly at least to the frost line.

10. The apparatus of claim 1 wherein the return air flow conduit means include perforated conduit means positioned around or in the perimeter portion of said mass for collecting air from the enveloped aggregate mass and transferring the collected air to the interior of the generally enclosed structure at peripheral locations in its interior space above but in proximity to the slab/floor thereof and wherein the air circulation system further includes air distributor means positioned at an interior portion of said mass for distributing air from the interior of the generally enclosed structure into said mass in opposed directions toward said perforated conduit means.

11. The apparatus of claim 10 wherein said air distributor means is an elongate perforated plenum positioned within said mass.

12. The apparatus of claim 10 wherein said air distributor means is a perforated plenum in the form of a closed loop fed by a plurality of conduits adapted to receive air from the interior of the generally enclosed structure.

13. The apparatus of claim 12 wherein (i) said closed loop is positioned around the perimeter of an earth, gravel or sand mass adapted to support an interior portion of said slab/floor, (ii) said plurality of conduits is embedded in said earth, gravel or sand mass, and (iii) said aggregate mass is positioned around the perimeter of said closed loop.

14. The apparatus of claim 10 further including footings extending downwardly into the ground at the site of said structure, said footings being positioned and adapted to support the underside of said slab/floor at least around the perimeter thereof, said system being further characterized in that said film sheet envelops at least said aggregate mass and said perforated conduit means.

15. The apparatus of claim 14 wherein the film sheet envelope comprises plastic sheeting positioned above and plastic sheeting positioned below said aggregate mass and wherein the outer edges of the such plastic sheeting extend to and are held together by said footings and the ground adjacent thereto.

16. A support and temperature regulating structural system for use with a generally enclosed structure having at least enclosing walls, a roof and a slab/floor, which structural system comprises:

a. an expanded clay lightweight aggregate mass having void air spaces therein enabling air to pass through said mass;

b. film sheet enveloping said mass for preventing water flow into said mass from the exterior; and c. means adapted to direct a flow of air from the interior of said enclosed structure through a substantial portion of said mass and thence back into the interior of said structure;

said mass being further characterized in that said mass together with its film sheet envelope rests upon and is supported by the ground at the site of said structure and is adapted to communicate with and support a substantial area of the underside of said slab/floor; said system being further characterized in that the ground upon which said mass together with its film sheet envelope rests includes an upper layer of sand.

17. The system of claim 16 further characterized in that said mass is comprised of a plurality of aggregate particles having a grain size in the range of about 0.5 to about 1 inch.

18. The system of claim 16 further characterized in that less than one half ($\frac{1}{2}$) of the volume of said mass is solid material, the balance of the volume being an enlarged continuous void air space.

19. The system of claim 16 further characterized in that it includes thermal insulation material extending downwardly into the ground at the site of said structure, said material being positioned around the perimeter of the site of said structure and adapted to thermally insulate said mass around the perimeter thereof.

20. The apparatus of claim 19 wherein said insulation material extends downwardly at least to the frost line.

21. An aerated thermal cap air circulation apparatus for generally enclosed structures, as a home, said apparatus comprising:

a. continuous slab means extending over a ground surface for supporting at least in part said generally enclosed structure; said slab means having a floor area which during use communicates with the interior of said structure, said slab means having a generally centrally positioned opening therethrough extending between the upper and lower surfaces of said slab means;

b. structurally supportive air circulation medium means subsurface to said slab means and structurally communicating with an underlying earth for forming a structural support to said slab means;

c. an enlarged continuous void air space formed between said slab means and the underlying earth, said air space being occupied partially by said air circulation medium means;

d. envelope means surrounding said air circulation medium means for confining air flow to and excluding water flow into said void air space;

e. blower means for circulating air between said structure interior and said void air space, said blower means directing the circulating air from said interior through said opening in said slab means and into a generally centrally positioned portion of said void air space;

f. conduit means for transmitting air flow from generally peripheral portions of said void air space to generally peripheral portions of said structure interior; and g. insulation means for thermally insulating said void air space and said air circulation medium means around the perimeter thereof and adapted to allow heat transfer between said void air space and the slab/floor and between said void air space and the underlying ground support.

22. The aerated thermal cap air circulation apparatus of claim 21 wherein said air circulation medium means comprises at least in part an aggregate mass.

23. The aerated thermal cap air circulation apparatus of claim 22 wherein said aggregate mass is an expanded clay lightweight aggregate mass.

24. The aerated thermal cap air circulation apparatus of claim 23 wherein said aggregate mass occupies less than one half ($\frac{1}{2}$) by volume of said enlarged continuous void air space.

25. The aerated thermal cap air circulation apparatus of claim 21 wherein said air circulation medium means comprises an expanded clay lightweight aggregate mass which occupies less than one half ($\frac{1}{2}$) by volume of said enlarged continuous void air space and wherein said envelope means is plastic film sheet surrounding said air circulation medium means.

26. The aerated thermal cap air circulation apparatus of claim 21 wherein there is further provided heat transfer means associated with said blower means for transferring heat between said heat transfer means and air flow through said blower means.

27. The aerated thermal cap air circulation apparatus of claim 21 further characterized in that said conduit means introduce the air flow from said void air space inwardly to generally peripheral portions of said structure interior at peripheral locations in said interior above but in proximity to said floor area.

28. The aerated thermal cap air circulation apparatus of claim 21 further characterized in that (i) said slab means is a concrete slab;

(ii) said air circulation medium means is an expanded clay lightweight aggregate mass comprised of a plurality of aggregate particles having a grain size between about 0.5 and about 1 inch;

(iii) said envelope means is plastic film sheet surrounding said aggregate mass;

(iv) said conduit means introduce the air flow from said void air space inwardly to generally peripheral portions of said structure interior at peripheral locations in said interior above but in proximity to said floor area; and (v) said aerated thermal cap air circulation apparatus further includes heat transfer means associated with said blower means for effecting heat exchange between said heat transfer means and air flow through said blower means.

29. An aerated thermal cap air circulation apparatus for generally enclosed structures, as a home, said apparatus comprising:

a. a generally enclosed structure having exterior wall and roof portions which define an interior to be heated or cooled;

b. continous slab means extending over a ground surface for supporting at least in part said generally enclosed structure; said slab means having a floor area which during use communicates with said interior;

c. structurally supportive air circulation medium means subsurface to said slab means and structurally communicating with an underlying earth for forming a structural support to said slab means;

d. an enlarged continuous void air space formed between said slab means and the underlying earth, said air space being occupied partially by said air circulation medium means;

e. envelope means surrounding said air circulation medium means for confining air flow to said void air space;

f. blower means for circulating air between said structure interior and said void air space;

g. return air flow conduit means communicating between said void air space and said interior for balancing air flow between said void air space and said structure interior; and h. insulation means for thermally insulating said void air space and said air circulation medium means around the perimeter thereof and adapted to allow heat transfer between said void air space and the slab/floor and between said void air space and the underlying ground support.

30. The aerated thermal cap air circulation apparatus of claim 29 further comprising supplemental heat transfer means for transferring heat between said heat transfer means and to the air contained within said void air space.

31. The aerated thermal cap air circulation apparatus of claim 29 wherein said air circulation medium means comprises at least in part an aggregate mass.

32. The aerated thermal cap air circulation apparatus of claim 31 wherein said aggregate mass is an expanded clay lightweight aggregate mass.

33. The aerated thermal cap air circulation apparatus of claim 29 wherein said air circulation medium means occupies less than one half (½) by volume of said enlarged continuous void air space.

34. The aerated thermal cap air circulation apparatus of claim 29 wherein said envelope means is film sheet surrounding said air circulation medium means.

35. The aerated thermal cap air circulation apparatus of claim 29 wherein said air circulation medium means is comprised of a plurality of aggregate particles of expanded clay lightweight aggregate occupying partially said void air space formed between slab means and the underlying earth, each of said particles being closely contacted with one another to form an aggregate of structural support to said slab means.

36. The aerated thermal cap air circulation apparatus of claim 29 wherein there is further provided heat transfer coils associated with said blower means for transferring heat between said coils and air flow through said blower means.

37. The aerated thermal cap air circulation apparatus of claim 29 further comprising filtration means for filtering air flowing through said air circulation medium means.

38. The aerated thermal cap air circulation apparatus of claim 37 wherein said filtration means comprises an activated charcoal content added to said air circulation medium means.

39. The aerated thermal cap air circulation apparatus of claim 29 wherein said air circulation medium means is a mass of an expanded lightweight aggregate as specified in ASTM designation C331-64T.

40. The aerated thermal cap air circulation apparatus of claim 29 wherein said air circulation medium means is a mass of an expanded clay lightweight aggregate as specified in ASTM designation C331-68T.

41. The aerated thermal cap air circulation apparatus of claim 29 wherein said blower means circulates air from said structure interior downwardly into an interior portion of said void air space and then in opposed directions through said air circulation medium means and thence upwardly from perimeter portions of said void air space to perimeter portions of said structure interior above but in proximity to the floor area.

* * * * *

UNITED STATES PATENT AND TRADEMARK OFFICE

CERTIFICATE OF CORRECTION

PATENT NO. : 4,541,479

DATED : September 17, 1985

INVENTOR(S) : Hervin J. Bergeron, Jr.

It is certified that error appears in the above-identified patent and that said Letters Patent is hereby corrected as shown below:

Column 7, lines 6, 11 and 18, reads "VISQUUEEN®" and should read -- VISQUEEN® --.

Column 11, line 54, reads "and a structurally" and should read -- and structurally --.

Signed and Sealed this

*Twenty-fourth* Day of *December 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,541,479

DATED : SEPTEMBER 17, 1985

INVENTOR(S) : HERVIN J. BERGERON, JR.

It is certified that error appears in the above-identified patent and that said Letters Patent is hereby corrected as shown below:

Face page, Item [60] should read as follows:

"Continuation-in-part of Ser. No. 54,659, Jul. 3, 1979, Pat. No. 4,505,325, Ser. No. 135,073, Mar. 28, 1980, abandoned, Ser. No. 239,982, Mar. 3, 1981, Ser. No. 240,152, Mar. 3, 1981, and Ser. No. 530,211, Sep. 8, 1983, which is a division of Ser. No. 230,375, Feb. 2, 1981, Pat. No. 4,440,343."

Signed and Sealed this

*Twenty-seventh* Day of *May 1986*

[SEAL]

*Attest:*

DONALD J. QUIGG

*Attesting Officer*

*Commissioner of Patents and Trademarks*